US011713535B2

(12) United States Patent
Hwang et al.

(10) Patent No.: US 11,713,535 B2
(45) Date of Patent: Aug. 1, 2023

(54) WASHING MACHINE AND CONTROL METHOD THEREOF

(71) Applicant: LG ELECTRONICS INC., Seoul (KR)

(72) Inventors: Yonggeun Hwang, Seoul (KR); Ji Hun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 365 days.

(21) Appl. No.: 16/935,618

(22) Filed: Jul. 22, 2020

(65) Prior Publication Data

US 2021/0071336 A1 Mar. 11, 2021

(30) Foreign Application Priority Data

Sep. 9, 2019 (KR) ..... 10-2019-0111632

(51) Int. Cl.
*D06F 39/14* (2006.01)
*D06F 39/12* (2006.01)
(Continued)

(52) U.S. Cl.
CPC ..... *D06F 39/14* (2013.01); *D06F 37/42* (2013.01); *D06F 39/12* (2013.01); *D06F 31/00* (2013.01);
(Continued)

(58) Field of Classification Search
CPC ..... D06F 37/18; D06F 37/28; D06F 37/42; D06F 39/12; D06F 39/14; D06F 2103/40; D06F 2105/44
See application file for complete search history.

(56) References Cited

U.S. PATENT DOCUMENTS 6,732,552 B2 * 5/2004 Kim ..... D06F 34/20 312/270.3
2011/0265524 A1 11/2011 Kim et al.
(Continued)

FOREIGN PATENT DOCUMENTS

EP 3064637 9/2016
KR 101319879 10/2013
(Continued)

OTHER PUBLICATIONS

AU Office Action in Australian Appln. No. 2020210209, dated Jun. 16, 2021, 6 pages.
(Continued)

*Primary Examiner* — Joseph L. Perrin
(74) *Attorney, Agent, or Firm* — Fish & Richardson P.C.

(57) ABSTRACT

A washing machine includes: a case defining a receiving space and an open surface, a drawer provided in the case and configured to slide out through the open surface of the case, the drawer being configured to perform at least one of a washing operation, a rinsing operation, a spin-drying operation, or an air-drying operation for laundry, and a locking device configured to limit a sliding motion of the drawer relative to the case. The locking device includes: a holder provided on an inner wall surface of the case, a lever provided in the drawer and configured to be inserted into the holder, and an elastic member provided in a portion of the holder to which the lever is inserted and configured to come into contact with the lever in a space between the holder and the lever.

14 Claims, 9 Drawing Sheets

(51) Int. Cl.

| | |
|---|---|
| ***D06F 37/42*** | (2006.01) |
| *D06F 105/44* | (2020.01) |
| *D06F 103/40* | (2020.01) |
| *D06F 33/30* | (2020.01) |
| *D06F 34/28* | (2020.01) |
| *D06F 31/00* | (2006.01) |
| *E05C 1/00* | (2006.01) |
| *E05C 1/02* | (2006.01) |
| *D06F 37/18* | (2006.01) |
| *D06F 37/28* | (2006.01) |

(52) U.S. Cl.

CPC ..... *D06F 33/30* (2020.02); *D06F 34/28* (2020.02); *D06F 37/18* (2013.01); *D06F 37/28* (2013.01); *D06F 2103/40* (2020.02); *D06F 2105/44* (2020.02); *E05C 1/006* (2013.01); *E05C 1/02* (2013.01); *E05Y 2900/312* (2013.01)

(56) References Cited

U.S. PATENT DOCUMENTS

| | | | | |
|---|---|---|---|---|
| 2014/0196507 | A1 | 7/2014 | Lee et al. | |
| 2014/0225379 | A1* | 8/2014 | Fukumoto | E05C 9/045 292/40 |
| 2016/0258099 | A1* | 9/2016 | Lee | D06F 31/00 |
| 2018/0119326 | A1 | 5/2018 | Jung et al. | |
| 2018/0371667 | A1 | 12/2018 | Hatta et al. | |

FOREIGN PATENT DOCUMENTS

| | | |
|---|---|---|
| KR | 101319884 | 10/2013 |
| KR | 1020170135113 | 12/2017 |
| WO | WO2016140472 | 9/2016 |

OTHER PUBLICATIONS

EP Extended European Search Report in European Appln. No. 20185938.6, dated Nov. 30, 2020, 9 pages.

* cited by examiner

WASHING MACHINE AND CONTROL METHOD THEREOF

CROSS-REFERENCE TO RELATED APPLICATION

This present application claims the benefit of priority to Korean Patent Application No. 10-2019-0111632, entitled "WASHING MACHINE AND CONTROL METHOD THEREOF," filed on Sep. 9, 2019, in the Korean Intellectual Property Office, the entire disclosure of which is incorporated herein by reference.

BACKGROUND

Technical Field

The present disclosure relates to a washing machine and a control method thereof and, more particularly, to a washing machine in which withdrawal of a drawer is restricted by a locking device while the washing machine is operating, and a control method thereof.

Description of Related Art

In general, a washing device refers to a device capable of performing washing and/or drying of clothes, etc. Here, one washing device can perform either one of the washing or drying function or both of the washing and drying functions.

Recently, washing machines provided with a steam supplying apparatus for refresh functions such as wrinkle removal, odor removal, static electricity removal, etc. are being used.

A household is generally equipped with one large-capacity washing machine. Thus, when a user wants to sort laundry by type and wash the sorted laundry separately, the user has to operate the washing machine multiple times.

For example, if the user wants to sort laundry by adult clothing, underwear, and baby clothing, the user would have to operate the washing machine twice: first for the adult clothing, and second for the underwear and the baby clothing. Due to this, a relatively long time and a relatively large amount of energy are required for doing laundry in such a manner.

In addition, when it comes to energy consumption, it is not desirable to use the traditional large-capacity washing machine for a small load of laundry. Washing courses of such a large-capacity washing machine are mostly set for a large load of laundry. Accordingly, even when a small load of laundry is washed, a relatively large amount of water may be used.

Furthermore, since a relatively large-sized drum or inner tub is rotated in such a large-capacity washing machine, power consumption may also be relatively high. Moreover, since the washing courses of a large-capacity washing machine are mostly set for a large load of laundry, it takes a relatively long time to do the laundry.

In addition, since it is desirable to frequently wash such items as underwear and baby clothes, demand for a relatively small-capacity washing machine rather than a traditional large-capacity washing machine has been increasing.

A representative example of such a small-capacity washing machine is the pedestal washing machine, which is generally produced in the form of a drawer that is drawable from a case. Here, withdrawal of the drawer has to be restricted according to the operational state of the washing machine, and for this, various locking devices can be applied.

However, when additional members such as a locking device are added to the washing machine in the manufacturing process thereof, occurrence of noise and vibration may be unavoidable due to clearances formed between the members, and this may cause inconvenience for users.

Accordingly, research and development is underway to provide a washing machine having a structure capable of implementing an appropriate locking function and, at the same time, minimizing occurrence of noise and vibration caused by the clearance between members.

With regard to such a washing machine, Korean Patent Registration No. 10-1319884 (hereinafter referred to as "related art 1") discloses a pedestal washing machine.

Specifically, related art 1 discloses a pedestal washing machine including a case, a drawer installed within the case to be drawn out from the case in the front direction, an outer tub installed within the drawer to receive washing water, and an inner tub formed to rotate and receive laundry within the outer tub.

However, related art 1 only discloses that the drawer can be drawn out from the case such that the pedestal washing machine can be appropriately used as necessary, and does not consider any feature of appropriately restricting withdrawal of the drawer according to the operational state of the washing machine.

Moreover, Korean Patent Registration No. 10-1319879 (hereinafter referred to as "related art 2") discloses a pedestal washing machine having a locking device.

Specifically, related art 2 discloses a pedestal washing machine including a case, a drawer formed to slide within the case and do laundry, and a locking device capable of fixing the drawer within the case such that the drawer is not drawn out from the case.

Although a locking device capable of restricting withdrawal of the drawer is disclosed in related art 2, the locking device of related art 2 may be implemented merely by applying a general latching structure to a washing machine. Accordingly, related art 2 does not consider any feature for preventing noise and vibration from occurring in the locking device when the washing machine is operating.

As described above, traditional washing machines have a limitation in that when a locking device is applied to the washing machines, noise and vibration may occur due to a clearance formed between members of the locking device when the washing machine is operating.

SUMMARY OF THE INVENTION

The present disclosure is directed to addressing said shortcomings of existing washing machines.

An aspect of the present disclosure is directed to providing a washing machine and a control method thereof characterized in that a locking function may be appropriately implemented according to an operational state of the washing machine, such that operations of the washing machine are safely performed.

Another aspect of the present disclosure is directed to providing a washing machine and a control method thereof characterized in that when a locking device is installed for implementing a locking function in the washing machine, occurrence of noise and vibration caused by a clearance formed between members of the locking device may be reduced, such that user convenience and endurance of members are improved.

Still another aspect of the present disclosure is directed to providing a washing machine and a control method thereof characterized in that even when an interruption occurs between members of the locking device due to, for example, a manufacturing error when the washing machine is manufactured or an operational error when the washing machine is operated, the effect of the interruption may be minimized, and thus the locking function may be smoothly implemented.

Aspects of the present disclosure are not limited to what has been described above, and other aspects not mentioned above will be apparent from the following description to those skilled in the art to which the present disclosure pertains.

A washing machine and a control method thereof according to an aspect of the present disclosure are characterized in that withdrawal of a drawer from a case may be restricted during an operation of the washing machine. Specifically, as a lever installed in the drawer is inserted into a holder installed in inner wall surfaces of the case, sliding of the drawer with respect to the case may be restricted.

In addition, the washing machine and the control method thereof according to an aspect of the present disclosure are characterized in that noise and vibration occurring between members of a locking device installed in the washing machine may be reduced. Specifically, as an elastic member installed in a portion of the holder to which the lever is inserted comes into close contact with the lever in a clearance formed between the holder and the lever, the locking function may be implemented.

In addition, the washing machine and the control method thereof according to an aspect of the present disclosure are characterized in that the elastic member may be formed in a plate shape, and as the lever is inserted into the holder through a through hole formed in the elastic member, withdrawal of the drawer may be restricted.

Further, the washing machine and the control method thereof according to an aspect of the present disclosure are characterized in that even when an interruption occurs between members of the locking device, effects of the interruption may be minimized, and thus no functional deterioration may be caused. Specifically, the elastic member may be cut in at least a portion of thereof that surrounds the through hole, such that even when a lateral movement direction of the lever does not precisely correspond to a formation position of the through hole, the lever can be inserted into the holder through the through hole.

Moreover, the washing machine and the control method thereof according to an aspect of the present disclosure are characterized in that a coupling portion may be formed in the holder to protrude from the holder so as to support the elastic member.

In addition, the washing machine and the control method thereof according to an aspect of the present disclosure are characterized in that a locking motor may provide a driving force for inserting the lever into the holder.

Further, the washing machine and the control method thereof according to an aspect of the present disclosure are characterized in that a pair of levers may be inserted respectively into a pair of holders installed on inner side surfaces of the case at either side thereof, such that withdrawal of the drawer from the case is restricted.

In addition, the washing machine and the control method thereof according to an aspect of the present disclosure are characterized in that a signal for withdrawal of the drawer may be inputted through a switch.

In addition, the washing machine and the control method thereof according to an aspect of the present disclosure are characterized in that a display may display that the drawer is in a state in which sliding thereof has been restricted.

Moreover, the washing machine and the control method thereof according to an aspect of the present disclosure are characterized in that in response to a signal for withdrawal of the drawer being repeatedly inputted, an operation being performed in the washing machine may be temporarily paused, and the restriction of withdrawal of the drawer may be released.

Further, the washing machine and the control method thereof according to an aspect of the present disclosure are characterized in that in response to the drawer being put back into the case after the operation was temporarily paused and the restriction of withdrawal of the drawer was then released, withdrawal of the drawer may be restricted again.

Aspects that can be achieved by the present disclosure are not limited to what has been described above, and other aspects can be clearly understood from the following description by those skilled in the art to which the present disclosure pertains.

Effects of the washing machine and the control method thereof according to the present discloser are as follows.

According to at least one embodiment of the present disclosure, as the lever installed in the drawer is inserted into the holder installed in the inner wall surface of the case, sliding of the drawer with respect to the case may be restricted. Accordingly, the locking function may be appropriately implemented during an operation of the washing machine, and thus the operation of the washing machine may be safely performed.

According to at least one embodiment of the present disclosure, as an elastic member installed in a portion of the holder to which the lever is inserted comes into close contact with the lever in a clearance formed between the holder and the lever, the locking function may be implemented. Accordingly, occurrence of noise and vibration caused by the clearance formed between the holder and the lever may be reduced, and thus user convenience and endurance of members may be improved.

In addition, according to at least one embodiment of the present disclosure, as the elastic member is formed in a plate shape, and the lever is inserted into the holder through the through hole formed in the elastic member, withdrawal of the drawer from the case may be restricted. Accordingly, the elastic member may completely surround an outer circumference of the lever, and thus occurrence of noise and vibration may be minimized.

Furthermore, according to at least one embodiment of the present disclosure, as at least a portion of the elastic member that surrounds the through hole is cut, the lever can be inserted into the holder through the through hole even when a lateral movement direction of the lever does not precisely correspond to a formation position of the through hole. Accordingly, even when an interruption occurs between the lever and the elastic member due to, for example, a manufacturing error or an operational error, the locking function may be smoothly implemented.

Moreover, according to at least one embodiment of the present disclosure, since the coupling portion formed to protrude from the holder supports the elastic member, the elastic member may be stably fixed in the holder even when pressure caused by movement of the lever is applied to the elastic member.

Further, according to at least one embodiment of the present disclosure, since a driving force for inserting the lever into the holder is provided by the locking motor, the restriction of withdrawal of the drawer may be more precisely and easily performed.

Also, according to at least one embodiment of the present disclosure, a pair of levers may be inserted respectively into a pair of holders installed on inner side surfaces of the case at either side thereof, to thereby restrict withdrawal of the drawer from the case. Accordingly, eccentric pressure may be prevented from being applied between the drawer and the case, and thus the restriction of withdrawal of the drawer from the case may be more stably performed.

In addition, according to at least one embodiment of the present disclosure, since a signal for withdrawal of the drawer is inputted through the switch, the user may draw out the drawer from the case as necessary.

Furthermore, according to at least one embodiment of the present disclosure, since the display notifies the user of a locked state of the drawer by displaying that the drawer is in a state in which withdrawal thereof has been restricted, the display may help the user with a selection of a signal that the user wants to input to the washing machine.

Further, according to at least one embodiment of the present disclosure, in response to a signal for withdrawal of the drawer being repeatedly inputted, an operation being performed in the washing machine may be temporarily paused, and then the restriction of withdrawal of the drawer may be released. Accordingly, a process of confirming whether the user really wants to draw out the drawer or whether the user has inputted a signal by mistake may be performed before temporarily pausing the operation and releasing the restriction of withdrawal of the drawer.

Also, according to at least one embodiment of the present disclosure, in response to the drawer being put back into the case after the operation was temporarily paused and the restriction of withdrawal of the drawer was then released, withdrawal of the drawer may be restricted again. Accordingly, the operation of the washing machine may be safely resumed immediately once withdrawal of the drawer is no longer required.

Further scope of applicability of the present disclosure will be apparent from the detailed description below. However, since various changes and modifications within the spirit and scope of the present disclosure can be clearly understood by those skilled in the art, it should be understood that specific embodiments, such as the detailed description and preferable exemplary embodiments of the present disclosure, are just given as examples.

BRIEF DESCRIPTION OF THE DRAWINGS

The foregoing and other aspects, features, and advantages of the invention, as well as the following detailed description of the embodiments, will be better understood when read in conjunction with the accompanying drawings. For the purpose of illustrating the present disclosure, there is shown in the drawings an exemplary embodiment, it being understood, however, that the present disclosure is not intended to be limited to the details shown because various modifications and structural changes may be made therein without departing from the spirit of the present disclosure and within the scope and range of equivalents of the claims. The use of the same reference numerals or symbols in different drawings indicates similar or identical items.

DETAILED DESCRIPTION

Figure 1:
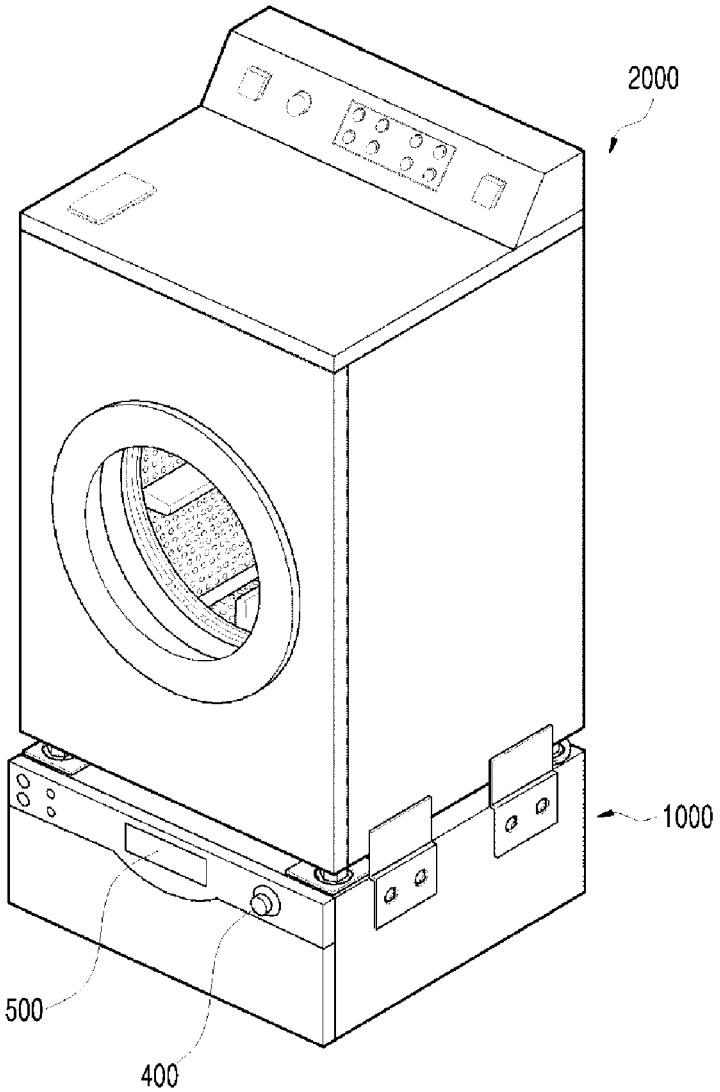
FIG. 1 is a perspective view illustrating an example of a state in which a washing machine according to an embodiment of the present disclosure has been installed.

Advantages and features of the present disclosure and methods for achieving them will become apparent from the descriptions of aspects herein below with reference to the accompanying drawings. However, the present disclosure is not limited to the aspects disclosed herein but may be implemented in various different forms. The aspects are provided to make the description of the present disclosure thorough and to fully convey the scope of the present disclosure to those skilled in the art. It is to be noted that the scope of the present disclosure is defined only by the claims.

The shapes, sizes, ratios, angles, the number of elements given in the drawings are merely exemplary, and thus, the present disclosure is not limited to the illustrated details. Like reference numerals designate like elements throughout the specification.

In relation to describing the present disclosure, when the detailed description of the relevant known technology is determined to unnecessarily obscure the gist of the present disclosure, the detailed description may be omitted.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

Hereinafter, preferable exemplary embodiments of the present disclosure will be described in detail referring to the attached drawings. In the following description, known functions or features will be omitted in order to clarify the gist of the present disclosure.

Figure 2:
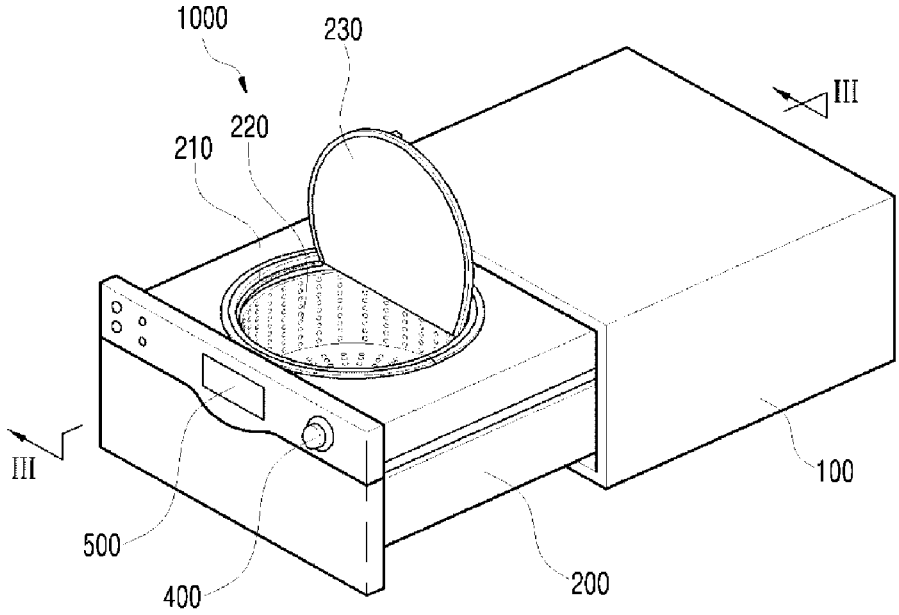
FIG. 2 is a perspective view illustrating a state of the washing machine according to an embodiment of the present disclosure in which a drawer has been drawn out from a case.
Figure 3:
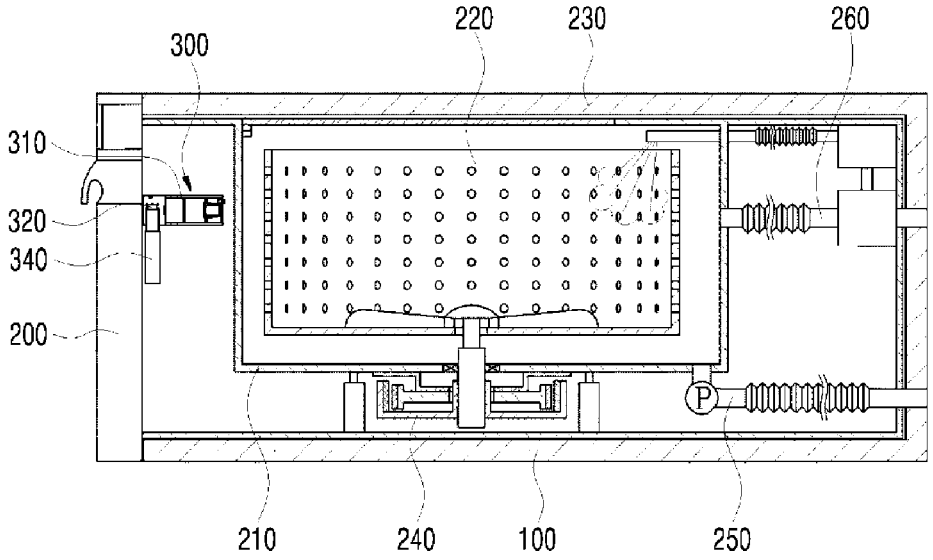
FIG. 3 is a cross-sectional view schematically illustrating the washing machine according to an embodiment of the present disclosure.

FIG. 1 is a perspective view illustrating an example of a state in which a washing machine according to an embodiment of the present disclosure has been installed. FIG. 2 is a perspective view illustrating a state of the washing machine according to an embodiment of the present disclosure in which a drawer has been drawn out from a case. FIG. 3 is a cross-sectional view schematically illustrating the washing machine according to an embodiment of the present disclosure.

As illustrated in FIGS. 1 to 3, a washing machine 1000 according to an embodiment of the present disclosure may be installed below another washing machine 2000 or a laundry dryer to serve as a pedestal and, at the same time, may perform at least one of a washing operation, a rinsing operation, a spin-drying operation, or an air-drying operation for a small load of laundry.

Specifically, the washing machine 1000 according to an embodiment of the present disclosure may include a case 100 and a drawer 200. The case 100 may include a receiving space formed therein, and one surface of the case 100 may be open. Here, the case 100 may be produced to have an appropriate size and a relatively strong structure such that the other washing machine 2000 may be put onto the case 100.

The drawer 200 may be drawn out forward from the case 100. That is, the drawer 200 may be installed within the case 100 so as to slide towards the open surface of the case 100, and may perform at least one of the washing, rinsing, spin-drying, or air-drying operations for laundry.

For this, an outer tub 210 may be installed in the drawer 200 in a supported manner. Here, an upper frame may be disposed in the drawer 200 so as to cover an upper portion of the drawer 200, and the outer tub 210 may be formed integrally with the upper frame.

A door 230 may be installed in an upper opening of the outer tub 210. A door frame may be formed in the outer tub 210 to protrude from an inner wall surface of the outer tub 210 in a circumferential direction, and a door sealing material may be installed in the door 230. Accordingly, when the door 230 is closed, the door sealing material may come into contact with the door frame to thereby seal an upper portion of the outer tub 210.

In addition, a hook may be installed in the door 230. The hook may be inserted into a hook groove formed in the inner wall surface of the outer tub 210. The hook may be supported by a spring installed therein. In addition, the end of the hook may form a gentle slope, such that when sufficient force is applied to open or close the door 230, the hook may be inserted into the hook groove or released therefrom.

An inner tub 220 may be positioned within the outer tub 210. A plurality of through holes may be formed in the inner tub 220 such that washing water can flow into and out of the inner tub 220 therethrough. Here, the inner tub 220 may include a pulsator.

A motor 240 may be fixed to an outer bottom surface of the outer tub 210. The motor 240 may be an outer rotor-type motor 240, and a stator thereof may be fixed to the outer bottom surface of the outer tub 210. Also, a rotational shaft of a rotor may penetrate a bottom of the outer tub 210 to be connected to a bottom of the inner tub 220.

A drain pipe 250 may be connected to a lower portion of the outer tub 210 for drainage. One end of the drain pipe 250 may be fixed to the case 100 to be connected to outside of the case 100, and the other end of the drain pipe 250 may be connected to the lower portion of the outer tub 210. A drain pump may be installed to be connected to the drain pipe 250.

A portion of the drain pipe 250 may be formed as a corrugated pipe which can be extended in a length direction thereof. Accordingly, when the drawer 200 is drawn out forward, the corrugated pipe may be extended. Here, a telescopic structure may be used instead of the corrugated pipe.

A washing water supply pipe 260 may be connected to an upper portion of the outer tub 210 for water supply. One end of the washing water supply pipe 260 may be connected to the upper portion of the outer tub 210, and the other end of the washing water supply pipe 260 may be connected to a water supply valve. The washing water supply pipe 260 may also include a corrugated pipe.

A control panel may be installed on a front surface of the drawer 200. The control panel may be an input interface for receiving input of commands for operations of the washing machine 1000 such as washing course and the like, and may be provided with various buttons and a knob. Also, the control panel, as a display for visually displaying operation information of the washing machine 1000, may be provided with an LCD window and/or an LED lamp.

Here, the control panel may be provided with a main controller configured to control the motor 240 and the water supply valve or the drain pump.

A locking device 300 may be installed for the purpose of restricting sliding of the drawer 200 within the case 100, and may maintain a state in which the drawer 200 is within the case 100. Here, the locking device 300 may preferably include an electronic component so as to be controlled by the main controller.

For example, the locking device 300 may be needed to be controlled such that the drawer 200 is not drawn out from the case 100 while an operation of the washing machine 1000 is being performed, that is, while the inner tub 220 is rotating. If the drawer 200 is drawn out from the case 100 while the inner tub 220 is rotating, relatively strong vibration may occur. Accordingly, the main controller may be configured to detect a rotating state of the inner tub 220 and control the locking device 300.

Here, the rotating state of the inner tub 220 may also be detected through a rotating state of the motor 240.

Figure 4:
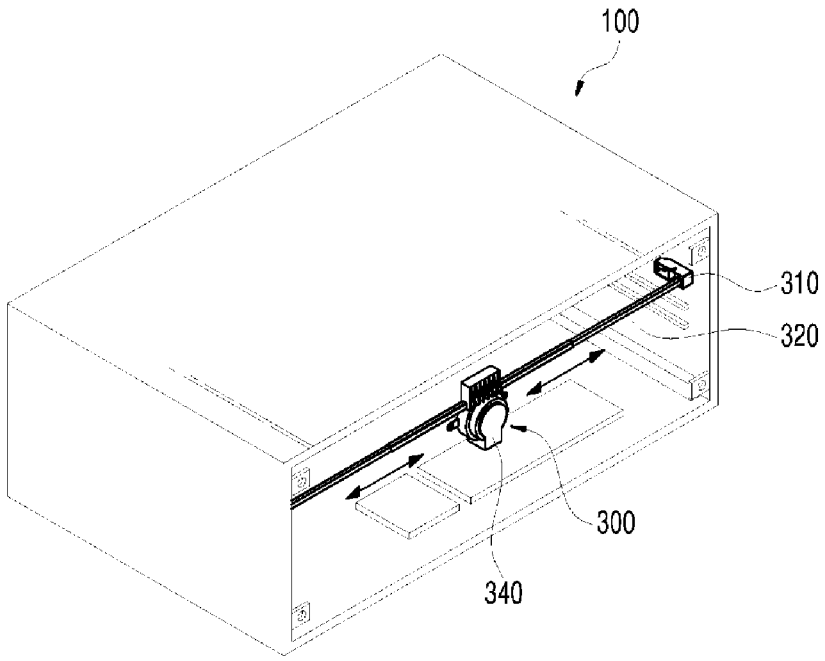
FIG. 4 is an exemplary view illustrating a state of the washing machine according to an embodiment of the present disclosure in which the drawer has been locked by a locking device.
Figure 5:
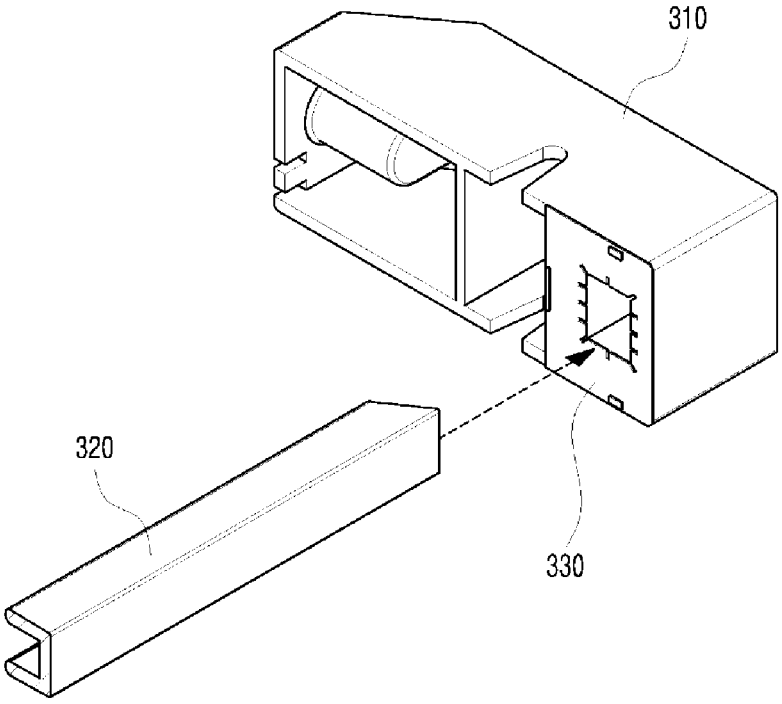
FIG. 5 is a view illustrating, in more detail, a holder, a lever, and an elastic member of the washing machine according to an embodiment of the present disclosure.

FIG. 4 is an exemplary view illustrating a state of the washing machine according to an embodiment of the present disclosure in which the drawer has been locked by a locking device. FIG. 5 is a view illustrating, in more detail, a holder, a lever, and an elastic member of the washing machine according to an embodiment of the present disclosure.

As illustrated in FIGS. 4 and 5, the locking device 300 of the washing machine 1000 may include a holder 310, a lever 320, and an elastic member 330.

The holder 310 may be a part that is installed on an inner wall surface of the case 100, and may support the lever 320 when the lever 320 is inserted into the holder 310. The lever 320 may be a part that is installed in the drawer 200 and can be inserted into the holder 310. When it is required to restrict withdrawal of the drawer 200, the lever 320 may be inserted into the holder 310 so as to restrict sliding of the drawer 200 with respect to the holder 310.

That is, when the lever 320 is inserted into the holder 310, sliding of the drawer 200 coupled to the lever 320 may be restricted by the holder 310 coupled to the case 100. On the contrary, when the lever 320 is not inserted into the holder 310, no restraining force is applied between the drawer 200 and the case 100, and thus the drawer 200 may freely slide into and out of the case 100.

The elastic member 330 may be a part that is installed in a portion of the holder 310 to which the lever 320 is inserted, and thus when the lever 320 is inserted into the holder 310, the elastic member 330 may come into close contact with the lever 320 in a clearance space between the holder 310 and the lever 320. That is, the elastic member 330 may be interposed between the lever 320 and the holder 310 when the lever 320 is inserted into the holder 310, and as each of the lever 320 and the holder 310 comes into close contact with the elastic member 330, the lever 320 may be fastened to the holder 310.

Accordingly, a fastening force between the lever 320 and the holder 310 may be improved, and restriction of withdrawal of the drawer 200 may be more stably maintained.

As described above, in the washing machine 1000, as the lever 320 installed in the drawer 200 is inserted into the holder 310 installed on the inner wall surface of the case 100, sliding of the drawer 200 with respect to the case 100 may be restricted. Accordingly, a locking function may be appropriately implemented while the washing machine 1000 is operating, and thus operations of the washing machine 1000 may be safely performed.

In particular, as the clearance between the lever 320 and the holder 310 is reduced by interposing the elastic member 330 therebetween, noise and vibration that may occur in the clearance between the lever 320 and the holder 310 while the washing machine 1000 is operating may be reduced.

The clearance between the lever 320 and the holder 310 may be generated due to a manufacturing error caused in the process of manufacturing the washing machine 1000. Further, even if the washing machine 1000 is produced in a very precise manner, generation of the clearance may be inevitable due to, for example, an operational error caused by a deformation or the like during an operation of the washing machine 1000.

Accordingly, by interposing the elastic member 330 between the lever 320 and the holder 310, any clearance therebetween caused by any error may be filled, and thus any issue relating to noise and vibration may be resolved.

As described above, in the washing machine 1000, the locking function may be performed as the elastic member 330, installed in a portion of the holder 310 to which the lever 320 is inserted, comes into close contact with the lever 320 in the clearance between the lever 320 and the holder 310. Accordingly, the noise and vibration caused due to the clearance between the lever 320 and the holder 310 may be reduced, and thus user convenience and durability of members may be improved.

Figure 6:
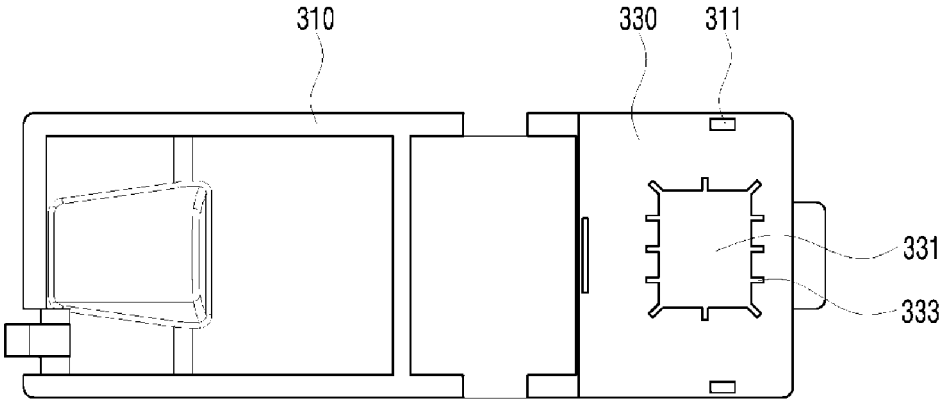
FIG. 6 is a side view illustrating a state in which the elastic member has been installed in the holder of the washing machine according to an embodiment of the present disclosure.
Figure 7:
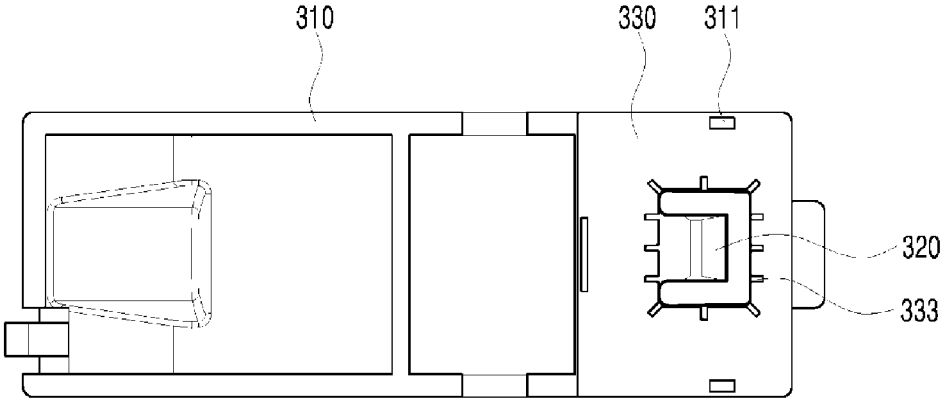
FIG. 7 is a side view illustrating a state in which the lever has been inserted into the holder through the elastic member of FIG. 6.
Figure 8:
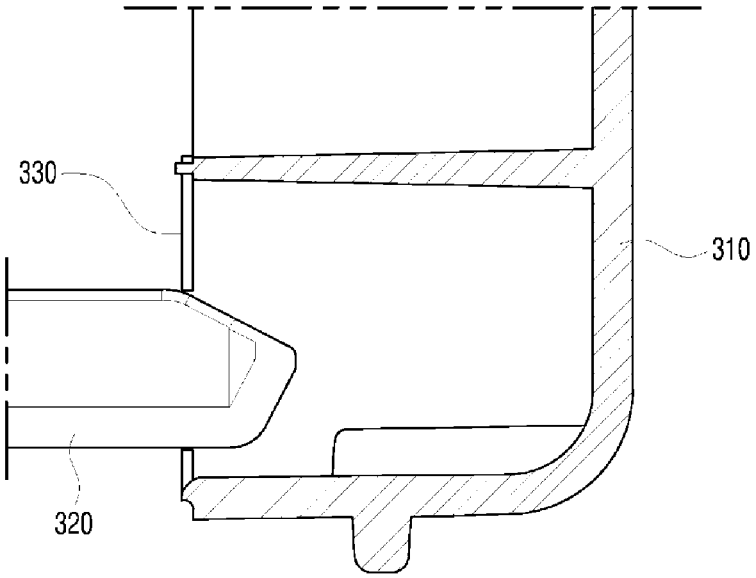
FIG. 8 is a transverse sectional view illustrating a state in which the lever has been inserted into the holder through the elastic member of FIG. 6.

FIG. 6 is a side view illustrating a state in which the elastic member has been installed in the holder of the washing machine according to an embodiment of the present disclosure. FIG. 7 is a side view illustrating a state in which the lever has been inserted into the holder through the elastic member of FIG. 6. FIG. 8 is a transverse sectional view illustrating a state in which the lever has been inserted into the holder through the elastic member of FIG. 6.

Hereinafter, the locking device 300 in the washing machine 1000 according to an embodiment of the present disclosure will be described in more detail referring to FIGS. 6 to 8.

In the washing machine 1000 according to an embodiment of the present disclosure, the elastic member 330 may be formed in a plate shape in which a through hole 331 is formed, and the lever 320 may be inserted into the holder 310 through the through hole 331 to thereby restrict sliding of the drawer 200.

That is, the elastic member 330 may be formed of a planar member of a plate shape, wherein a plane thereof may be disposed along a longitudinal direction. In addition, the through hole 331, corresponding to the shape of the lever 320, may be formed in a central portion of the elastic member 330.

The lever 320 may move in a lateral direction with respect to the elastic member 330 to be inserted into the holder 310 through the through hole 331. Then, when the lever 320 is inserted into the holder 310 through the through hole 331, an outer circumference of the lever 320 may be completely surrounded by the elastic member 330.

Accordingly, no portion of the lever 320 may come into direct contact with the holder 310, and only indirect contact may be possible between the lever 320 and the holder 310 through the elastic member 330. As a result, a displacement difference between the lever 320 and the holder 310 may be offset by the elastic member 330, and thus the noise and vibration occurring between the lever 320 and the holder 310 may be further reduced.

As described above, the elastic member 330 of the washing machine 1000 according to the present embodiment may be formed in a plate shape, and the lever 320 may be inserted into the holder 310 through the through hole 331 formed in the elastic member 330 such that withdrawal of the drawer 200 is restricted. Accordingly, an outer circumference of the lever 320 may be completely surrounded by the elastic member 330, and thus the noise and vibration may be minimized.

In the washing machine 1000 according to the embodiment, a cut portion 333 may be formed in at least a portion of the elastic member 330 that surrounds the through hole 331. That is, as illustrated in FIGS. 6 and 7, the elastic member 330 may be formed in such a shape that a portion of the elastic member 330 that surrounds the through hole 331 is cut along a radial direction thereof.

As described in detail above, for the lever 320 to be inserted into the holder 310 through the through hole 331 formed in the elastic member 330, a lateral movement direction of the lever 320 has to correspond to a formation position of the through hole 331 in the elastic member 330.

However, due to, for example, deformation caused by use of the washing machine 1000, a situation may occur in which the lateral movement direction of the lever 320 does not precisely correspond to the formation position of the through hole 331 in the elastic member 330.

Here, if the through hole 331 is not sufficiently large compared to the shape of the lever 320, the lever 320 cannot be inserted into the holder 310 through the through hole 331, and as a result, the function of restricting withdrawal of the drawer 200 may not be implemented.

On the contrary, if the through hole 331 is too large compared to the shape of the lever 320, the lever 320 may not come into close contact with the elastic member 330 and may move within the through hole 331, which may lead to additional noise and vibration.

Accordingly, it is desirable for the through hole 331 to be formed only in a size precisely corresponding to the shape of the lever 320, and at the same time, for the cut portion 333 to be formed in at least a portion of the elastic member 330 that surrounds the through hole 331, such that even when the lateral movement direction of the lever 320 does not precisely correspond to the formation position of the through hole 331, the lever 320 can be inserted into the holder 310 through the through hole 331 having the cut portion 333.

As described above, in the washing machine 1000 according to the embodiment, as at least a portion of the elastic member 330 that surrounds the through hole 331 is cut, the lever 320 may be inserted into the holder 310 through the through hole 331 even when the lateral movement direction of the lever 320 does not precisely correspond to the formation position of the through hole 331. Accordingly, even when an interruption occurs between the lever 320 and the elastic member 330 due to, for example, a manufacturing error or an operational error, a locking function may be smoothly implemented.

In the washing machine 1000 according to the present embodiment, a coupling portion 311 may be formed in the holder 310 to protrude from the holder 310 towards the elastic member 330 so as to support the elastic member 330.

As described in detail above, when the lever 320 is inserted into the holder 310 through the through hole 331, pressure caused by lateral movement of the lever 320 may be applied to the elastic member 330, which may cause the elastic member 330 to be pulled or pushed.

Here, if the elastic member 330 is not firmly supported in the holder 310, the elastic member 330 may deviate from the original position thereof, and thus the function of preventing occurrence of noise and vibration may not be implemented.

Accordingly, it is required to firmly support the elastic member 330 by forming the coupling portion 311 in the holder 310 such that the elastic member 330 does not deviate from the original position thereof.

In the washing machine 1000 according to the present disclosure, since the coupling portion 311 formed to protrude from the holder 310 supports the elastic member 330, the elastic member 330 may be stably fixed to the holder 310 even when pressure caused by the lateral movement of the lever 320 is applied to the elastic member 330.

In the washing machine 1000 according to the present embodiment, the locking device 300 may further include a locking motor 340 providing driving force by which the lever 320 is inserted into the holder 310. That is, when the locking motor 340 is driven, the lever 320 may move in the lateral direction and may be inserted into the holder 310. In addition, the locking motor 340 may move the lever 320 in the opposite direction such that the lever 320 is released from the holder 310.

Here, the locking motor 340 may be electrically connected to a separate power source and drive the lever 320 by converting electric energy to kinetic energy.

In the washing machine 1000 according to the present embodiment, since the driving force for inserting the lever 320 into the holder 310 is provided by the locking motor 340, the function of restricting withdrawal of the drawer 200 may be more precisely and easily performed.

In the washing machine 1000 according to the present embodiment, each of the holder 310 and the lever 320 may be installed to be symmetric with respect to the locking motor 340 in both directions of the locking motor 340. That is, as illustrated in FIG. 4, the holder 310 and the lever 320 may be installed such that sliding of the drawer 200 is restricted by inner wall surfaces of the case 100 facing each other at either side of the case 100.

Even when withdrawal of the drawer 200 is restricted through the holder 310 and the lever 320, the installation state of the drawer 200 with respect to the case 100 may be changed when a relatively large external force is applied thereto.

Here, if the drawer 200 is supported with respect to only one of the inner wall surfaces of the case 100, the drawer 200 may be warped when it is positioned within the case 100, which may lead to major functional problems of the washing machine 1000.

Accordingly, it is required that the drawer 200 is supported with respect to both of the inner wall surfaces of the case 100 facing each other at either side of the case 100 such that no warpage of the drawer 200 occurs in a sliding direction thereof.

In the washing machine 1000 according to the present embodiment, a pair of levers 320 respectively may be inserted into a pair of holders 310 installed in the inner side surfaces of the case 100 at either side thereof to restrict withdrawal of the drawer 200. Accordingly, eccentric pressure may be prevented from being applied between the drawer 200 and the case 100, and thus the function of restricting withdrawal of the drawer 200 may be more stably performed.

In the washing machine 1000 according to the present embodiment, the locking device 300 may further include a switch 400 for receiving input of a signal for operating the locking motor 340 therethrough. That is, as illustrated in FIGS. 1 and 2, a switch 400 may be installed in the washing machine 1000 such that a signal for withdrawal of the drawer 200 can be inputted through the switch 400.

A situation may arise in which the user wants to draw out the drawer 200 while an operation of the washing machine 1000 is being performed. Here, forcibly drawing out the drawer 200 may cause damage to the washing machine 1000. Therefore, it is required to allow a signal for withdrawal of the drawer 200 to be inputted through the switch 400, such that other components of the washing machine 1000 are operated according to the inputted signal.

For example, it may be preferable that, in response to a signal being inputted through the switch 400, the main controller, which was described above, performs control such that operation of the inner tub 220 is paused, and then a locked state of the locking device 300 is released.

In the washing machine 1000 according to the present embodiment, since a signal for drawing out the drawer 200 is inputted through the switch 400, the user may draw out the drawer 200 from the case 100 when a situation requiring withdrawal of the drawer 200 occurs while an operation is being performed in the washing machine 1000.

In the washing machine 1000 according to the present embodiment, the locking device 300 may further include a display 500 configured to display that the drawer 200 is in a state in which sliding thereof has been restricted, according to whether the lever 320 has been inserted into the holder 310.

That is, the display 500 may visually display, to the user, whether withdrawal of the drawer 200 has been restricted.

For example, the user who wants to draw out the drawer 200 while an operation of the washing machine 1000 is being performed may input a signal through the switch 400. Then, the display 500 may display a time point when the user would be able to draw out the drawer 200 from the case 100.

Or, if the user unintentionally pushes the switch 400, the display 500 may display that the drawer 200 is in a locked state, and may require the user to confirm that the user really wants to draw out the drawer 200.

In the washing machine 1000 according to the present embodiment, since the display 500 notifies the user of the locked state of the washing machine 1000 by displaying that the drawer 200 is in a state in which withdrawal has been restricted, the display 500 may help the user with selection of a signal that the user wants to input to the washing machine 1000.

Figure 9:
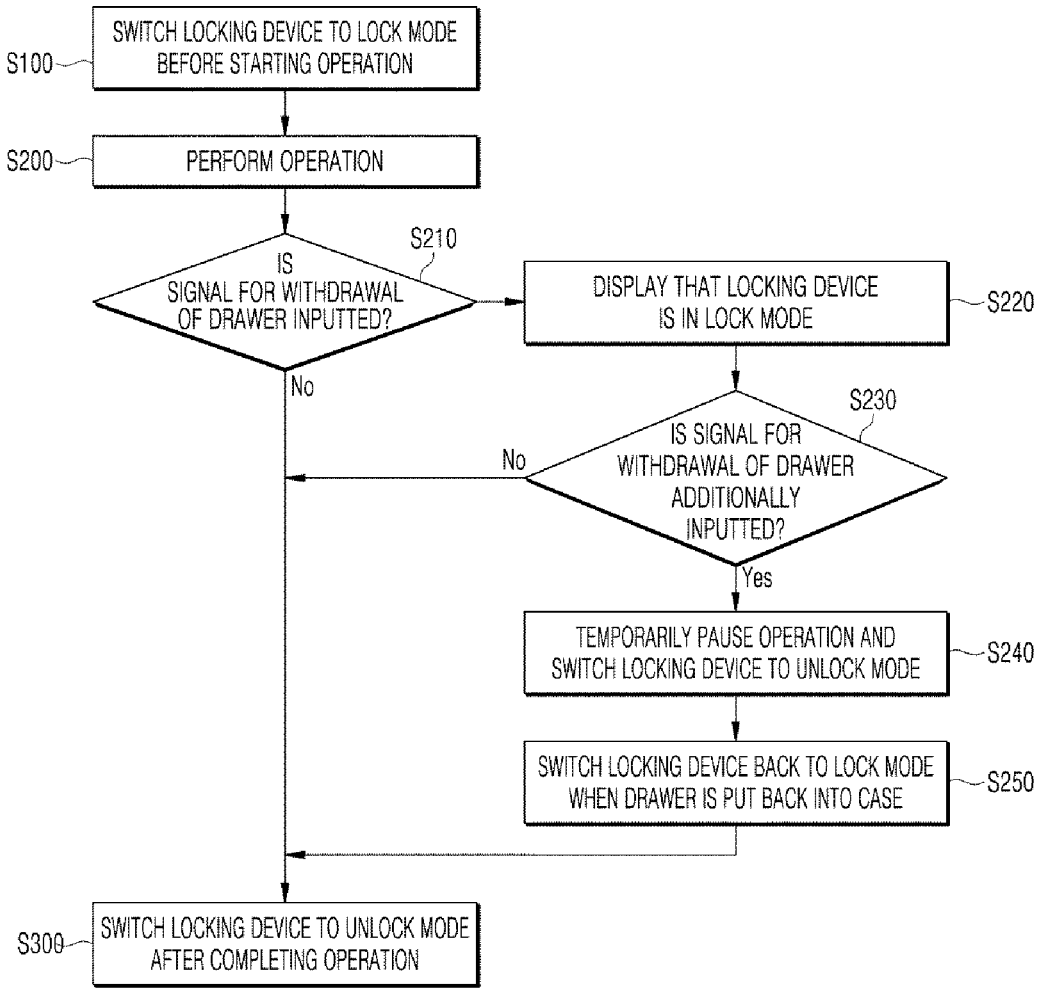
FIG. 9 is a flowchart illustrating a control method of the washing machine according to an embodiment of the present disclosure.

FIG. 9 is a flowchart illustrating a control method of the washing machine according to an embodiment of the present disclosure.

The control method of the washing machine according to an embodiment of the present disclosure will now be described referring to FIG. 9. Here, the control method of the washing machine according to the present embodiment may include main features of the washing machine 1000 described in detail above. Therefore, the description of the control method of the washing machine will be made referring to FIGS. 1 to 8 together.

First, before an operation of the washing machine 1000 is started, the locking device 300 may be switched to a lock mode (S100). Here, the lock mode refers to a state in which withdrawal of the drawer 200 has been restricted. So, in the lock mode, the locking device 300 may be controlled such that the drawer 200 is not unnecessarily drawn out from the case 100 while an operation of the washing machine 1000 is being performed.

In S100, the lever 320, which is installed in the drawer 200, may be inserted into the holder 310, which is installed in the inner wall surface of the case 100. Here, the elastic member 330, which is installed in a portion of the holder 310 to which the lever 320 is inserted, may come into close contact with the lever 320 in the clearance between the holder 310 and the lever 320.

Next, an operation may be performed in the drawer 200 (S200). That is, at least one of a washing operation, a rinsing operation, a spin-drying operation, or an air-drying operation for laundry may be performed in the drawer 200 in a state in which withdrawal of the drawer 200 has been restricted.

Thereafter, when the operation is completed, the locking device 300 may be switched to an unlock mode (S300). Here, the unlock mode refers to a state in which withdrawal of the drawer 200 is not restricted, and in which, as the operation of the washing machine 1000 has been completed, the user can draw out the drawer 200. Accordingly, the locking device 300 may be controlled such that withdrawal of the drawer 200 is not restricted.

In the control method of the washing machine according to the present embodiment, S200 may include S220 in which, in response to a signal for withdrawal of the drawer 200 being inputted through the switch 400, the display 500 displays that the locking device 300 is in the lock mode.

That is, it may be determined whether a signal for withdrawal of the drawer 200 has been inputted through the switch 400 (S210). On the basis of a determination that a signal for withdrawal of the drawer 200 has not been inputted, the washing machine 1000 may proceed to S300 after completing the operation of S200.

On the contrary, in response to a determination that a signal for withdrawal of the drawer 200 has been inputted, the display 500 may display that the locking device 300 is in the lock mode, in order to confirm whether the user really wants to draw out the drawer 200, or whether the switch 400 has been operated by mistake.

Here, S200 may further include S240 in which, in response to a signal for withdrawal of the drawer 200 being additionally inputted through the switch 400 after S220, the mode of the locking device 300 is changed to the unlock mode after the operation being performed is temporarily paused.

That is, after the display 500 displays that the locking device 300 is in the lock mode in S220, it may be determined whether a signal for withdrawal of the drawer 200 has been additionally inputted through the switch 400 (S230). If the user recognizes that the switch 400 has been operated by mistake and does not additionally input a signal for withdrawal of the drawer 200, the washing machine 1000 may proceed to S300 after performing the operation being performed.

On the contrary, when a signal for withdrawal of the drawer 200 has been additionally inputted, which means the user really wants to draw out the drawer 200, the operation being performed may be temporarily paused, and then the locking device 300 may be controlled such that the drawer 200 can be drawn out.

As described above, in the control method of the washing machine according to the present embodiment, in response to a signal for withdrawal of the drawer 200 being repeatedly inputted, the operation being performed may be temporarily paused, and then the restriction of withdrawal of the drawer 200 may be released. Accordingly, the control method of the washing machine according to the present embodiment may include a process of confirming whether the user really wants to draw out the drawer 200 or whether the user has inputted a signal by mistake.

Furthermore, S200 may further include S250 in which the mode of the locking device 300 is returned to the lock mode in response to the drawer 200 being put back into the case 100 after S240.

That is, when the user pushes the drawer 200 back into the case 100 after the drawer 200 is drawn out from the case 100 by the user after S240, it may be assumed that there is no longer a situation requiring withdrawal of the drawer 200.

That is, when the user pushes the drawer 200 back into the case 100, it may be assumed that the user intends to resume the operation of the washing machine 1000. Accordingly, it may be required to restrict withdrawal of the drawer 200 again such that the operation of the washing machine 1000 is stably performed.

As described above, in the control method of the washing machine according to the present embodiment, in response to the drawer 200 being put back into the case 100 after the operation of the washing machine 1000 is temporarily paused and the restriction of withdrawal of the drawer 200 is released, withdrawal of the drawer 200 may be restricted again. Accordingly, the operation of the washing machine 1000 may be stably performed immediately once withdrawal of the drawer 200 is no longer required.

While specific exemplary embodiments of the present disclosure are described and illustrated above, it would be obvious to those skilled in the art that various modifications and variations thereto can be made within the spirit and scope of the present disclosure. Accordingly, such modifications or variations are not to be regarded as a departure from the spirit or scope of the present disclosure, and it is intended that the present disclosure cover the modifications and variations of the present disclosure provided they come within the scope of the appended claims and their equivalents.

What is claimed is:

1. A washing machine comprising:

a case defining a receiving space and an open surface;

a drawer provided in the case and configured to slide out through the open surface of the case, the drawer being configured to receive laundry for at least one of a washing operation, a rinsing operation, a spin-drying operation, or an air-drying operation of the washing machine; and a locking device configured to limit a sliding motion of the drawer relative to the case, wherein the locking device comprises:

a holder provided on an inner wall surface of the case, a lever provided in the drawer and configured to be inserted into the holder, and an elastic member provided in a portion of the holder to which the lever is inserted, the elastic member being configured to come into contact with the lever in a space between the holder and the lever, and wherein a portion of the elastic member is configured to come into contact with the lever based on elasticity and be deformed by pressure exerted to the portion contacting the lever to thereby absorb the pressure.

2. The washing machine of claim 1, wherein the elastic member has a plate shape and defines a through hole, and wherein the lever is configured to be inserted into the holder through the through hole to limit the sliding motion of the drawer.

3. The washing machine of claim 2, wherein a cut portion is provided in at least a portion of the elastic member surrounding the through hole.

4. The washing machine of claim 3, wherein a coupling portion is provided in the holder and protrudes toward the elastic member to support the elastic member.

5. The washing machine of claim 1, wherein the locking device further comprises a locking motor configured to provide driving force to insert the lever into the holder.

6. The washing machine of claim 5, wherein each of the holder and the lever is provided to be symmetric with respect to the locking motor in both directions of the locking motor.

7. The washing machine of claim 5, wherein the locking device further comprises a switch configured to receive an input signal to operate the locking motor.

8. The washing machine of claim 5, wherein the locking device further comprises a display configured to display a state of the drawer based on whether the lever has been inserted into the holder, the state indicating whether withdrawal of the drawer is restricted.

9. A locking device configured to limit a sliding motion of a drawer in a case of a washing machine, the locking device comprising:

a holder provided on an inner wall surface of the case;

a lever provided in the drawer and configured to be inserted into the holder; and an elastic member provided in a portion of the holder to which the lever is inserted, the elastic member being configured to come into contact with the lever in a space between the holder and the lever, wherein a portion of the elastic member is configured to come into contact with the lever based on elasticity and be deformed by pressure exerted to the portion contacting the lever to thereby absorb the pressure.

10. The locking device of claim 9, wherein the elastic member has a plate shape and defines a through hole, and wherein the lever is configured to be inserted into the holder through the through hole to limit the sliding motion of the drawer.

11. The locking device of claim 10, wherein a cut portion is provided in at least a portion of the elastic member surrounding the through hole, and wherein a coupling portion is provided in the holder protruding toward the elastic member to support the elastic member.

12. The locking device of claim 9, wherein the locking device further comprises a locking motor configured to provide driving force to insert the lever into the holder.

13. The locking device of claim 12, wherein the locking device further comprises a switch configured to receive an input of signal to operate the locking motor.

14. The locking device of claim 12, wherein the locking device further comprises a display configured to display a state of the drawer based on whether the lever has been inserted into the holder, the state indicating whether withdrawal of the drawer is restricted.

* * * * *